US005655554A

United States Patent [19]

Goldberg

[11] Patent Number: 5,655,554

[45] Date of Patent: Aug. 12, 1997

[54] COMBINATION COSMETIC APPLICATOR DEVICE

[76] Inventor: Diana K. Goldberg, 4512 Windsor La., Bethesda, Md. 20814

[21] Appl. No.: 722,617

[22] Filed: Sep. 27, 1996

[51] Int. Cl.[6] ..... A45D 40/24

[52] U.S. Cl. ..... 132/314; 401/17; 401/18; 401/34

[58] Field of Search ..... 132/314, 315; 401/17, 18, 34

[56] References Cited

U.S. PATENT DOCUMENTS

| | | | |
|---|---|---|---|
| D. 158,051 | 4/1950 | Compas . | |
| D. 158,114 | 4/1950 | Marsh . | |
| 478,358 | 7/1892 | Payne | 132/314 |
| 1,461,501 | 7/1923 | Slaiger | 132/314 |
| 1,598,365 | 8/1926 | Clarke | 132/314 |
| 1,614,374 | 1/1927 | Lupo | 132/314 |
| 2,111,767 | 3/1938 | Gimonet | 206/56 |
| 2,178,997 | 11/1939 | Mitchell | 132/314 |
| 2,215,161 | 9/1940 | Sapery | 132/314 |
| 2,458,063 | 1/1949 | Dulberg | 132/314 |
| 2,528,612 | 11/1950 | Schildkraut et al. | 132/314 |
| 2,571,620 | 10/1951 | Sala | 120/36 |
| 2,691,184 | 10/1954 | Miller et al. | 15/140.4 |
| 3,043,316 | 7/1962 | Bolser | 132/74.5 |
| 3,592,202 | 7/1971 | Jones | 132/314 |
| 3,677,271 | 7/1972 | Luciano | 132/314 |
| 3,688,450 | 9/1972 | Brockman . | |
| 3,917,416 | 11/1975 | Steyer . | |
| 4,557,618 | 12/1985 | Iwata et al. . | |
| 4,998,839 | 3/1991 | Bashir . | |
| 5,056,179 | 10/1991 | Capponi . | |

FOREIGN PATENT DOCUMENTS

| | | | |
|---|---|---|---|
| 1201060 | 12/1959 | France | 132/314 |

*Primary Examiner*—Paul J. Hirsch
*Attorney, Agent, or Firm*—Myers, Liniak & Berenato

[57] ABSTRACT

A selectively detachable combination cosmetic applicator device is provided. The cosmetic applicator device includes a nail polish applicator container that is releasably attached to a nail polish remover container. The device also incorporates an on-board chamber for storing absorbent materials or the like. The chamber is prohibited from contact with either the nail polish or the nail polish remover. The containers of the device can readily be refilled and can be used at the same time when they are detached.

10 Claims, 1 Drawing Sheet

COMBINATION COSMETIC APPLICATOR DEVICE

BACKGROUND OF THE INVENTION

The present invention relates to a dual applicator device fluids such as nail care products. More particularly, the present invention relates to an improved dual applicator device for applying and removing nail polish that features selectively detachable applicators and a separate on board carrying chamber for storing absorbent material or the like.

Through the years, the use of nail polish has continued to rise. From its beginning as a rather difficult material to use that was offered in a very limited range of colors and shades, it has now undergone significant change. Polishes are now available in virtually every color and shade and the characteristics of the material that they are manufactured from have likewise dramatically improved. Since nail polish is not permanent, however, the proliferation and variety of available polishes has also directly increased the need for nail polish remover. Likewise, the proliferation of colors has frequently produced situations where one might change their nail polish color to more readily complement different types of clothing or social activities, even in the course of a single day. This usually requires carrying multiple bottles.

The necessity of carrying remover and polish is further compounded by the fact that it is not uncommon for the polish to chip or crack after it is applied to one's nails and necessitate repair or reapplication of the polish. Since the polish is designed to color and adhere to ones nails for a period of time, problems have occurred when the containers for the polish have either spilled or in some way broken to allow the polish to pour onto, discolor and sometimes ruin other surfaces such as purses. Attempts have been made to make the containers for those materials stronger and more durable, but this has often significantly increased the cost of such containers.

A number of solutions have been proposed to aforementioned problems. These solutions, while being satisfactory for certain uses, have unfortunately still presented certain drawbacks. Improved applicator elements were developed, such as those taught in U.S. Pat. No. 4,998,839 to Basher. However, these applicators accommodated either nail polish or remover, but not both. Furthermore, they were not readily refillable and required the user to transport at least two separate bottles of material.

Several other solutions were directed towards incorporating a cosmetic applicator and remover into a single device. U.S. Pat. No. 2,691,184 to Miller, for example, discloses a cosmetic kit for the application and removal of lipstick that contains separate reservoirs for liquid lipstick and remover respectively in a single device. This particular device, however, was not separable into its component elements and was furthermore not readily refillable. This lack of separability essentially meant that a user could only use or uncap one of the liquid reservoirs at a time, rather than both at the same time. To do otherwise would cause leakage from the downwardly facing reservoir.

U.S. Pat. No. 3,043,316 to Bolser discloses an applicator for fluids containing a removable applicator section and solvent retaining section removably coupled by a coupling element. The Bolser design, however, involved the use of end caps that each had an annular ridge extending above the outer diameter of the sections they capped that could easily be accidentally removed from the respective applicators. This accidental removal caused spillage that would damage or ruin a purse or the like that it might be contained in. In addition, the coupling element of Bolser provided only for snap fitting of the reservoir elements which is prone to be either too tight and difficult to assemble, or too loose and therefore too readily capable of disassembly.

In addition, the diameter of the Bolser coupling element provided a ridge on either side extending above the applicator sections which again made it easy to inadvertently disengage the respective applicator elements. The coupling element was also entirely separate from the applicator and solvent retaining sections. If it were ever lost or damaged, then the sections could not thereafter be joined. The Bolser device likewise was not readily refillable, nor did it provide any structure to enable the carrying of absorbent materials or replacement tips for the applicator sections themselves.

It is therefore apparent that a need exists in the art for an improved cosmetic applicator device that overcomes these disadvantages.

SUMMARY OF THE INVENTION

It is therefore an object of the present invention to provide an improved cosmetic applicator device that accommodates both nail polish and nail polish remover in a single device that overcomes the drawbacks presented by prior art designs.

It is another object of the present invention to provide a cosmetic applicator device for both nail polish and remover that is separable.

It is a further object of the present invention to provide a cosmetic applicator device for both nail polish and remover wherein the separate elements can both be uncapped and used at the same time when they are separated from each other.

It is still a further object of the present invention to provide a cosmetic applicator device for nail polish and remover that is separable into its component parts and further contains an on-board chamber for storing either absorbent material and/or replacement pads for one of the applicators of the device.

It is yet another object of the present invention to provide a cosmetic device for both nail polish and remover separable into its component elements that provides a smooth, ridge-free outer surface.

It is still a further object of the present invention to provide a cosmetic applicator device for nail polish and remover that is easily and readily refillable.

Still another object of the present invention is to provide a cosmetic applicator device for nail polish and remover that joins all of its constituent components by means other than press fitting.

These and other objects of the present invention, which will become more apparent upon review of the detailed description to follow, are satisfied by a cosmetic applicator device comprising a nail polish container with connecting means located thereon adjacent to one of its ends, a nail polish remover container with means for connecting the container to the nail polish container, and a hollow cover selectively connectable to the nail polish container opposite the connecting means with the cover having an internal chamber that is sealed from leakage from the remover container and wherein the cover, the nail polish container and nail polish remover container have substantially the same external diameter when they are connected.

BRIEF DESCRIPTION OF THE DRAWINGS

The invention will be described further in connection with the attached drawings, wherein like reference numbers refer to corresponding parts throughout the several views of preferred embodiments of the invention and wherein.

DETAILED DESCRIPTION OF THE INVENTION

The combination cosmetic applicator device of the present invention is designed to provide a portable container that houses both nail polish and nail polish remover in separable containers along with a chamber for carrying absorbent material that is isolated from the fluids. The device is separable into its independent components and the containers for both the nail polish and remover can be easily stood on their respective bottoms when separated and can be uncapped at the same time. In addition, both of the containers are readily refillable.

The following description is meant to be exemplary of certain preferred embodiments of the present invention. It should be understood that many other embodiments and variations thereof are also contemplated in the spirit and scope of the present invention.

Figure 1:
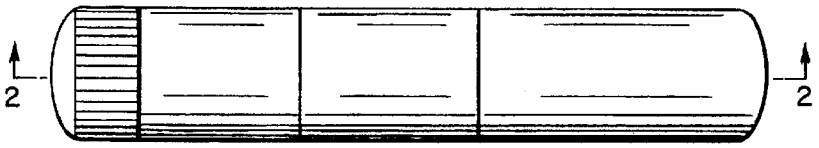
FIG. 1 is a side view of one embodiment of the present invention illustrating all components in their combined state.
Figure 2:
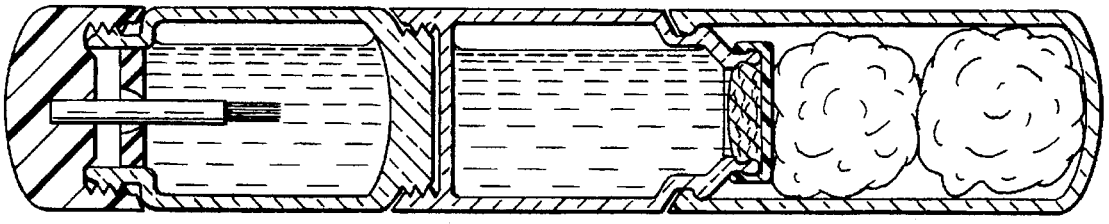
FIG. 2 is a cross sectional view of one embodiment of the present invention taken along the line 2—2 of FIG. 1.

Turning now to the drawing figures and in particular FIGS. 1 and 2, one embodiment of the cosmetic applicator device 10 of the present invention is illustrated. As can be seen, the outer diameter of the entire device 10 is smooth and does not present any outwardly extending ridges that could contribute to accidental separation of the components while it is not being used. The device 10 features a polish container 12, a polish removal container 14 and a hollow end cover 16 that are all separately detachable from one another. As particularly illustrated in FIG. 2, the polish container 12 is essentially hollow, allowing it to accommodate a quantity of a selected type of nail polish 40 therein. The container 12 is preferably constructed of a durable lightweight material that is not effected by the polish 40, such as plastic or the like. In addition, in most preferred embodiments, the container 12 is transparent to allow the user to readily determine both how much and what type of nail polish is contained within the container 12.

The polish container 12 has an open top 50 opposite a closed bottom 32. That container is sealed except at its top 50 to retain the polish 40 inside the container 12. Many known elements can be used to accomplish this purpose, such as a spill-proof ring 30 constructed of rubber or the like as illustrated in FIG. 2. This ring 30 seals the material off from escape in all places but at its center 31. The outer circumference of the top 50 of the polish container 12 is provided with a retaining mechanism such as screw threads 52 or the like. These threads 52 are designed to cooperate and engage opposing threads 54 that extend along the lower inner portion of the nail polish cap 22. It should be appreciated that other forms of connection can be utilized such as an annular ridge at the top 50 of the container 12 and a corresponding engaging ridge on the cap 22.

The polish cap 22 is preferable constructed of a material similar to that of the polish container 12 as described above. The cap 22 features a polish applicator 24 rigidly attached thereto. The polish applicator 24 extends from the cap 22 through the top 50 and open center 31 of the spill-proof ring 30 and into the interior of the container 12 where the polish 40 is contained. The tight fit between the applicator 24 and the ring 30 serves to keep any of the nail polish 40 from spilling from the interior of the container 12 when the cap 22 is fully attached. As an additional precaution, when the cap 22 fully engages the top 50 of the container 12, the top 50 bears tightly the cap 22. This prevents any fluid that might have passed through the ring 30 to escape no further.

The bottom 32 of the polish container 12 is designed to be substantially flat so that once it is separated it can be stood thereon in a stable manner while the applicator 24 is being used. The same is true of the cap 22 which due to its design can be readily be set on its end 25 without tipping over. The bottom 32 of the device 12 is further provided with screw threads 34 or a similar mechanism such as an annular ridge to allow it to be selectively attached and detached from the remover container 14. As a result, the two containers, can be selectively coupled an uncoupled without the use of any additional structure. In addition, attachment of the two containers 12 and 14 does not increase the external diameter in the area where they are attached. Rather it remains substantially the same as that of the containers 12 and 14 and does not extend above their respective diameters. The container 12 can also be readily refilled or cleaned by passing liquid through the open center 31 of the ring 30 or removing and subsequently replacing the ring 30 itself.

As described above, the polish remover container 14 is selectively detachable from the polish container 12. The remover container 14 features an extended threaded area 38 located below its closed bottom 36 that cooperates with the threads 34 located on the bottom 32 of the polish container 12. The threaded area 38 of the remover container 14 further serves to provide a stable base that allows the container 14 to stand thereon when it is separated from the container 12 without tipping or spilling. The remover container 14 is preferably constructed of materials that are durable and lightweight, similar to those described above in connection with the polish container 12. Similarly, it is transparent in most preferred embodiments to allow the user to readily determine the amount of polish contained within the container 14.

At its open end 56, the container 14 can be provided with a molded ridge 58 or screw threads that cooperate with a corresponding ridge 60 on the cover 16 as will be described below. The open end 56 further features a pad 26 that is preferably replaceable and made of a fibrous material or the like that allows liquid to pass therethrough, particularly when pressure is exerted against the pad 26. These pads 26 are designed to be replaceable since they frequently become soiled quite quickly when they are used to remove polish from nails. When the pad 26 is removed, the container 14 can readily be refilled or cleaned as necessary. The open end 56 of the container 14 is provided with an air and liquid tight seal by a seal cap 20 which can again be attached to the container 14 in a variety of known ways such as screw threads, ridges or similar structures.

As illustrated in FIG. 2, in preferred embodiments the device 10 is provided with a cover 16 that is selectively removable from the container 14. The cover 16 contains a hollow carrying chamber 18. This chamber can accommodate a variety of absorbent elements 28 such as cotton balls that are used during the application process and/or additional end pads 26 to be used when the pad 26 contained in the container 14 becomes unduly soiled.

The existence of the cover 16 and its chamber 18 in the device 10 provides a means for carrying absorbent material or the like within the device itself in a chamber 18 that is air and liquid tight from the outside environment and further isolated from contact with the remover 42 in the container 14. The contents of the chamber 18 can readily be removed and replaced when the cap 16 is detached from the container 14. Likewise, if the chamber 18 becomes soiled in any way, it can readily be cleaned and subsequently reattached to the container 14.

Additionally, the open end 61 of the cap 16 provides for a smooth, continuous, ridge-free outer diameter along the device 10 where it joins the cap 16 to the container 14. The cap 16 again is preferably constructed of a material similar to that described above in connection with the container 12 and 14 respectively. In most preferred embodiments, it is transparent so that one can readily determine if anything is contained in the chamber 18.

Figure 3:
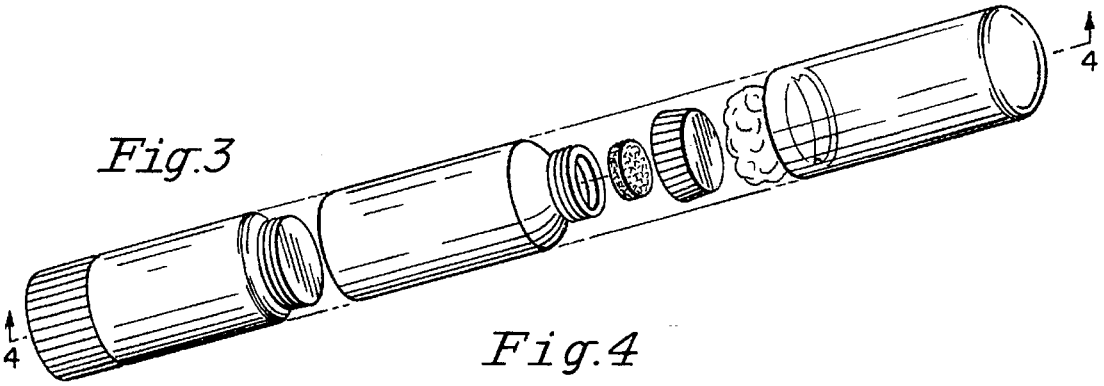
FIG. 3 is an exploded view of another embodiment of the present invention.
Figure 4:
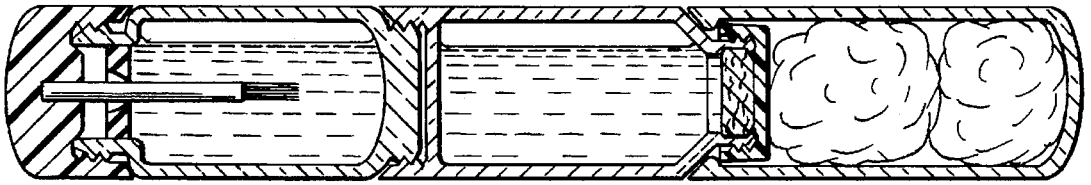
FIG. 4 is a cross sectional view of the embodiment of the present invention taken along the line 4—4 of FIG. 3.

Turning now to FIGS. 3 and 4, a slight alternative embodiment of the present invention is illustrated and generally indicated as 11. In this embodiment, the seal cap 20 is attached to the open end 56 of the remover container 14 by means of a screw thread. In addition, the open end 56 is not provided with a ridge to engage a ridge 60 of the cap 20. Instead, the ridge 60 of the cap 20 is kept in position when attached by engaging the annular lower surface 66 of the cap 20.

Figure 5:
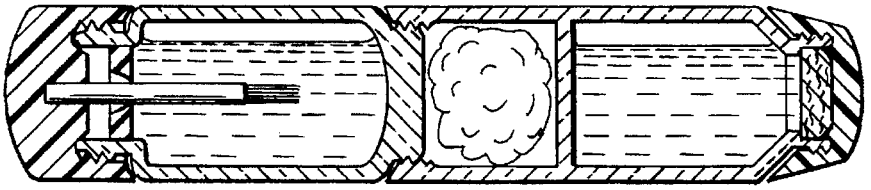
FIG. 5 illustrates a cross sectional view of another alternative embodiment of the present invention.

Moving now to FIG. 5, an additional embodiment of the present invention is illustrated and generally referred to as 13. This embodiment of the device 13 incorporates several significant modifications from those previously described. In this embodiment the end cap 16 has been eliminated. The device instead terminates at one end where the end cap 16 had been provided in prior embodiments with a modified seal cap 21 featuring extended shoulder portions 23 that taper from one end 67 of the cap 21 to the sidewalls 69 of the container 14 providing a smooth tapered diameter between those two points. In this embodiment, similar to those previously discussed, the polish container 12 and the remover container 14 are selectively attachable without requiring the use of any further elements. In this embodiment, however, the sidewalls 46 of the container 14 extend a much further distance away from the bottom 36 in order to provide an air and liquid tight carrying chamber 48 for absorbent materials or the like between the two containers 12 and 14 respectively when the components of the device 13 are fully attached. These extended sidewalls still permit the appropriate stability to the container 14 to stand on the ends 49 of the sidewalls 46 without spilling or tipping when it is separated from the container 12.

As should be noted, all of the embodiments of the device do not require modification of the polish container 12 and the end cap 22. As such, any of the above-described combinations can be selectively attached to the polish container 12.

While preferred embodiments of the present invention have been illustrated and described, it will be understood that changes and modifications may be made therein without departing from the invention in its broadened aspects.

Having thus described my invention, I claim:

1. A cosmetic applicator device, comprising:

a nail polish container having a first closed end and a second open end, said first end of said polish container having first segments projecting outwardly therefrom and a flat bottom and said second end of said polish container having second segments projecting outwardly therefrom;

an applicator closure having inwardly extending means for selectively cooperatively engaging said second segments of said second end of said container and thereby preventing any nail polish from leaking from said nail polish container;

a nail polish remover container having a closed bottom, an open end opposite said bottom and inwardly extending means for cooperatively engaging said first segments of said polish container and releasably connecting said polish container to said remover container adjacent said bottom;

said open end of said polish remover having segments projecting outwardly therefrom;

a removable absorbent pad covering substantially all of said entire open end of said remover container;

a cap having inwardly extending means for cooperatively engaging said segments of said open end of said polish remover container and for selectively sealing said remover container to thereby prevent any remover from leaking from said remover container;

a hollow cover having inwardly extending projections that engage said polish remover container between said bottom and said open end thereof, said cover having an internal chamber that is sealed from leakage from said remover container; and absorbent material removably contained in said chamber of said cover, wherein when said cover, said closure, said nail polish container and said nail polish remover container are engaged, said device has a substantially smooth, continuous and ridge free outer surface along its entire length.

2. The device of claim 1 wherein said nail polish container and said nail polish remover container are substantially rigid.

3. The device of claim 1 wherein said first and second segments of said polish container and said engaging means and said segments of said remover container are screw threads.

4. The device of claim 1 wherein said absorbent material includes a replacement absorbent pad for said remover container.

5. The device of claim 1 wherein said closure further comprises an internally mounted brush that extends into said nail polish container.

6. A cosmetic applicator device, comprising:

a nail polish container having a first closed end and a second open end, said first end of said polish container having first segments projecting outwardly therefrom and a flat bottom and said second end of said polish container having second segments projecting outwardly therefrom;

an applicator closure having inwardly extending means for selectively cooperatively engaging said second segments of said second end of said container and thereby preventing any nail polish from leaking from said nail polish container;

a nail polish remover container having first and second chambers, a first end and an opposing open end, said first end having inwardly extending means for cooperatively engaging said first segments of said polish container and releasably connecting said polish container to said remover container, said open end of said polish remover having segments projecting outwardly therefrom;

said first chamber of said remover container containing nail polish remover;

said second chamber of said nail polish remover container being separated from said first chamber and being located between said first end of said remover container and said first chamber;

a removable absorbent pad covering substantially all of said entire open end of said remover container;

a cap having inwardly extending means for cooperatively engaging said segments of said open end of said polish remover and selectively sealing said polish remover container to thereby prevent any remover from leaking from said remover container;

absorbent material removably contained in said second chamber of said remover container, wherein when said closure, said nail polish container, said nail polish remover container and said cap are engaged, said device has a substantially smooth, continuous and ridge free outer surface along its entire length.

7. The device of claim 6 wherein said nail polish container and said nail polish remover container are substantially rigid.

8. The device of claim 6 wherein said first and second segments of said polish container and said engaging means and said segments of said remover container are screw threads.

9. The device of claim 6 wherein said absorbent material includes a replacement absorbent pad for said remover container.

10. The device of claim 6 wherein said closure further comprises an internally mounted brush that extends into said nail polish container.

* * * * *